US005996459A

United States Patent [19]

Cornell et al.

[11] Patent Number: 5,996,459

[45] Date of Patent: Dec. 7, 1999

[54] PAPER TRIMMER

[75] Inventors: Robert W. Cornell, Schofield; Robert A. Seaton, Madison; Jerry C. Zollner, Schofield, all of Wis.

[73] Assignee: Fiskars Inc., Madison, Wis.

[21] Appl. No.: 08/921,287

[22] Filed: Aug. 29, 1997

[51] Int. Cl.[6] ..... B26D 1/18

[52] U.S. Cl. ..... 83/485; 83/564; 83/614

[58] Field of Search ..... 83/455, 485, 489, 83/508, 564, 578, 614

[56] References Cited

U.S. PATENT DOCUMENTS

| | | | |
|---|---|---|---|
| 3,370,497 | 2/1968 | Busse | 83/455 |
| 3,532,018 | 10/1970 | Szabo | 83/455 |
| 3,766,816 | 10/1973 | Loveless | 83/489 |
| 5,069,097 | 12/1991 | Mori | 83/455 X |
| 5,103,710 | 4/1992 | Ross | 83/485 |
| 5,322,001 | 6/1994 | Boda | 83/455 X |
| 5,802,942 | 9/1998 | Cornell et al. | 83/455 |

*Primary Examiner*—Kenneth E. Peterson
*Attorney, Agent, or Firm*—Foley & Lardner

[57] ABSTRACT

A paper cutter or trimming device comprises a cutting board including measuring indicia, a rail assembly, and a carriage assembly including a circular blade. The indicia are calibrated in a scale measured from a predetermined cut line. The rail assembly is mounted in a perpendicular relation to the measuring indicia for pivotal movement between operative and inoperative positions with respect to the cutting board. The carriage assembly is mounted for sliding movement on the rail assembly. The cutting board may include a positive stop, and the rail assembly may be biased against the at least one stop when the rail assembly moves to the operative position.

5 Claims, 4 Drawing Sheets

PAPER TRIMMER

FIELD OF THE INVENTION

The present invention relates generally to paper cutting devices. More particularly, this invention pertains to improvements in a paper cutter comprising a cutting board, a rail assembly pivotally mounted on one end of the cutting board, and a rotary cutting blade carriage assembly mounted on the rail assembly for movement across the cutting board.

BACKGROUND OF THE INVENTION

The prior art discloses paper cutters including a carriage assembly mounted on a rail for translational movement across a cutting board to cut or trim various material. The rail is mounted for pivotal motion with respect to the cutting board to raise the carriage assembly above the paper sheets to allow for placement of the paper sheets to be cut. A circular blade is mounted in the carriage assembly for rotary motion of the circular blade as it passes over the paper sheets. The carriage assembly is biased to a retracted position on the rail when not in use. The carriage assembly is pushed down to move the blade into engagement with the stack of paper and then moved across the rail to cut or trim the paper. A self healing pad may be provided in the cutting board along the path of travel of the circular blade to provide a smooth cutting surface.

The above-described prior art paper cutters are not perfect and therefore can be improved in a number of ways. For example, the structural rigidity of the rail assembly of the cutters can be further increased to decrease flexure in the rail and thereby permit a straighter line when relatively long cuts are required. The cutters can also be provided with additional features designed to improve the accuracy of the cuts by eliminating the concern of stack-up tolerances which can accumulate between the various components of the cutter due to the separate manufacture and assembly of parts, and the general looseness between parts resulting from long-term use. Moreover, the self-healing pad and manner of attachment can be reconfigured to provide the pad with multiple useable cutting surfaces. In addition, the measuring indicia can be calibrated in at least two scales to increase the versatility of the cutter and eliminate the need for separate molds. These and other improvements, which will be apparent from the detailed description given hereinafter, would provide the above described types of paper cutters with enhanced cutting accuracy, increase longevity or useable life, and increased versatility.

SUMMARY OF THE INVENTION

In accordance with one aspect of the present invention, a paper cutter or trimming device comprises a cutting board, a rail assembly, a carriage assembly including a circular blade, and a biasing means. The cutting board includes measuring indicia and at least one positive stop. The indicia are calibrated in a scale measured from a predetermined cut line. The rail assembly is mounted in a perpendicular relation to the measuring indicia for pivotal movement between operative and inoperative positions with respect to the cutting board. The carriage assembly is mounted for sliding movement on the rail assembly. The biasing means biases the rail assembly against the at least one stop when the rail assembly moves to the operative position. The stop is positioned so that the circular blade aligns with the cut line for cutting or trimming paper sheets.

According to a further aspect of the present invention, the measuring indica are calibrated in first and second different scales measured from the predetermined cut line.

According to another aspect of the present invention, a self-healing mat is removably secured to the cutting board in alignment with the path of travel of the circular cutting blade. The mat is configured to provide at least two self-healing cutting surfaces. After one surface of the mat becomes worn beyond continued use, the mat can be repositioned so that another surface of the mat is exposed to the cutting blade.

According to yet another aspect of the present invention, the rail assembly includes a rail and a channel. The channel extends along one of a front face and a rear face of the rail. The carriage assembly is configured to engage the channel when the carriage assembly moves to the cutting position, and the engagement of the carriage assembly with the channel aligns the blade along the predetermined cut line. The rail may also be provided with an outwardly bowed reinforcing portion to increase torsional and beam strength.

Other advantages of the invention will become apparent from the detailed description given hereinafter. It should be understood, however, that the detailed description and specific embodiments are given by way of illustration only since, from this detailed description, various changes and modifications within the spirit and scope of the invention will become apparent to those skilled in the art.

BRIEF DESCRIPTION OF THE DRAWINGS

The preferred exemplary embodiment of the invention will hereinafter be described in conjunction with the appended drawings, wherein like numerals denote like elements and.

DETAILED DESCRIPTION OF A PREFERRED EXEMPLARY EMBODIMENT

Figure 1:
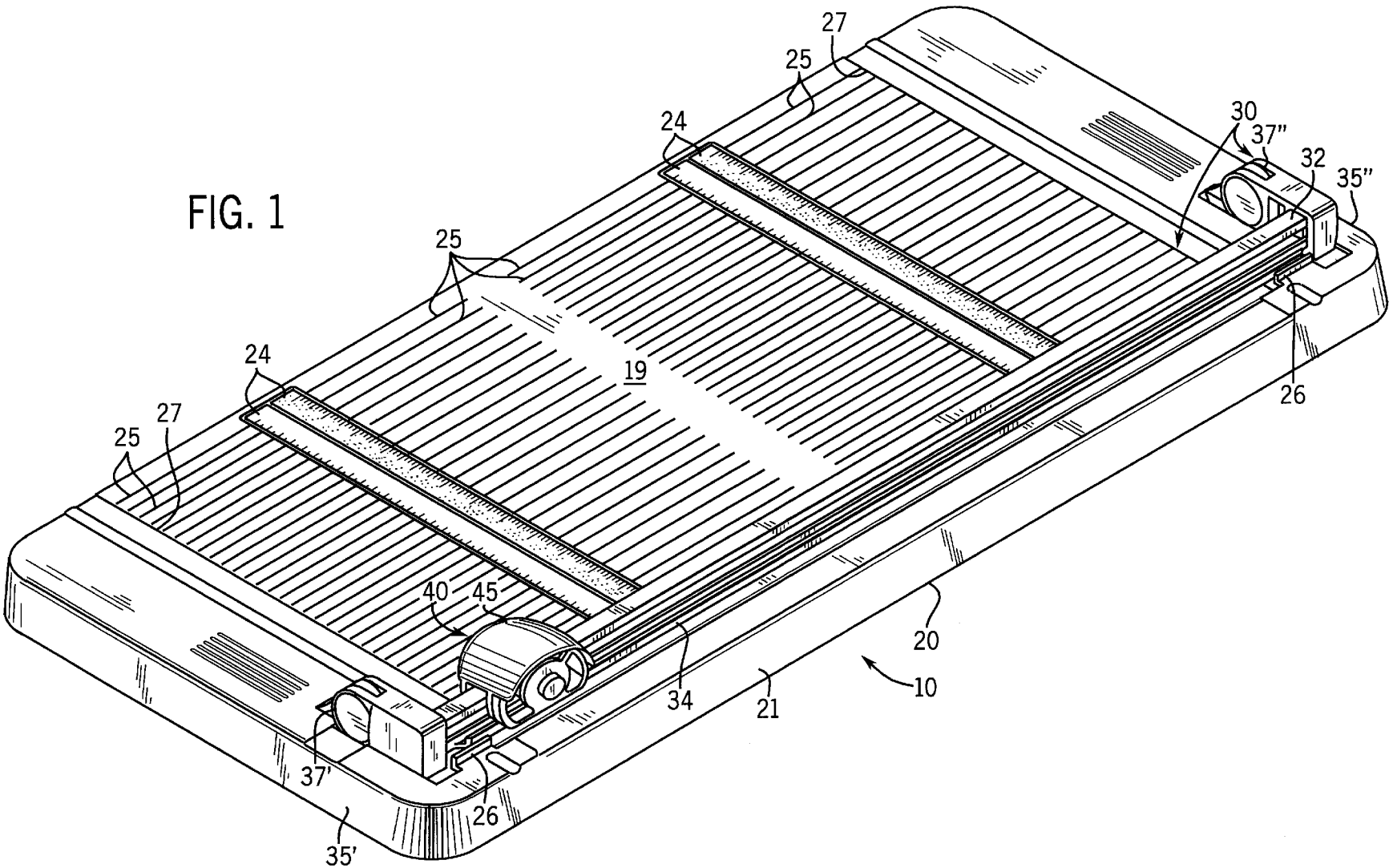
FIG. 1 is a perspective view of the cutting board showing the carriage assembly mounted on the rail assembly in an operative position.
Figure 4:
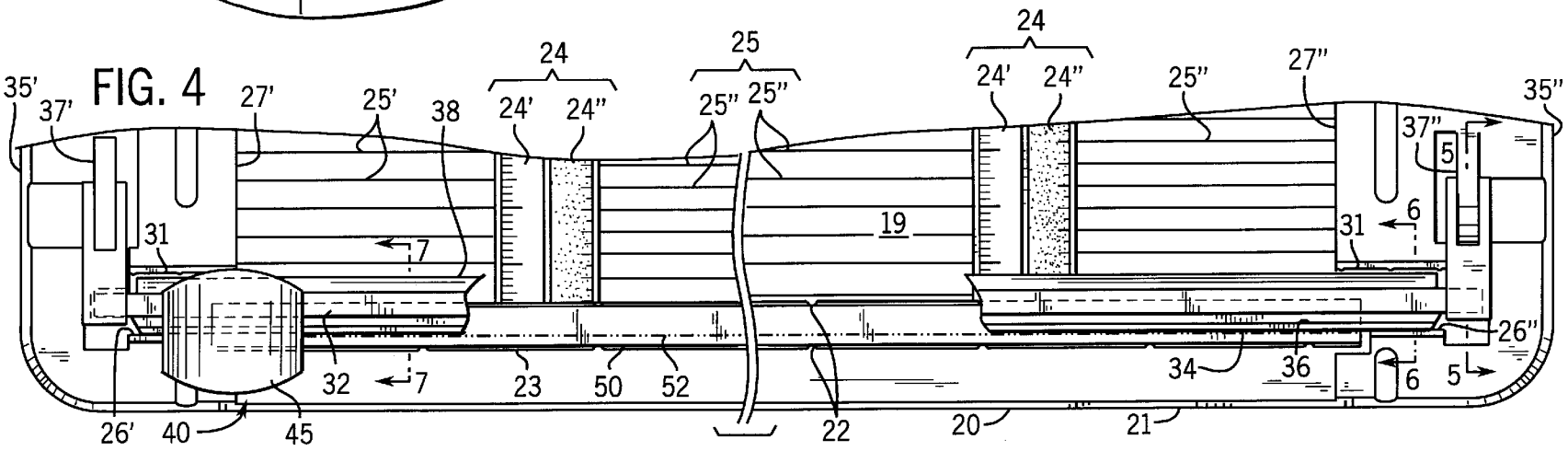
FIG. 4 is a top plan view of fragments of the cutting board showing the carriage assembly mounted on the rail assembly in the operative position.

Referring initially to FIGS. 1 and 4, a paper cutting or trimming device 10 includes a cutting board 20, an elongated rail assembly 30 pivotally mounted near a front edge 21 of board 20, and a cutter carriage assembly 40 slidably mounted to rail assembly 30 for movement across board 20 and parallel to edge 21. Board 20 has an upper surface 19 preferably provided with measuring indicia strips 24 calibrated in at least two different scales including one scale 24' calibrated in English units (e.g., inches) and another scale 24" calibrated in metric/SI units (e.g., centimeters). Of course, other units of length for scales 24 found convenient to users could be provided (i.e., units of scale common to the anticipated geographic area of sale). The scale (e.g., scale 24" in FIG. 4) most commonly used is preferably highlighted (or painted) in a color which contrast with board 20 for greater visibility and ease of use.

Elongated rail assembly 30 is pivotally attached to board 20 by pivots 37', 37" at opposite edges 35', 35", respectively, of board 20, and extends perpendicular to indicia scales 24. Carriage assembly 40 is slidably mounted on a rail 32 of rail assembly 30, and is provided with a blade 44 for cutting paper or similar sheet material (e.g., gasket material, plastic sign stock, and the like). Blade 44 is circular in shape and rotary in action, and may have a simple circumferentially sharpened edge for continuous straight-line cuts. Alternatively, blade 44 may have a formed edge for producing perforations, scalloped or pinked cuts, or other variations of cut.

Figure 2:
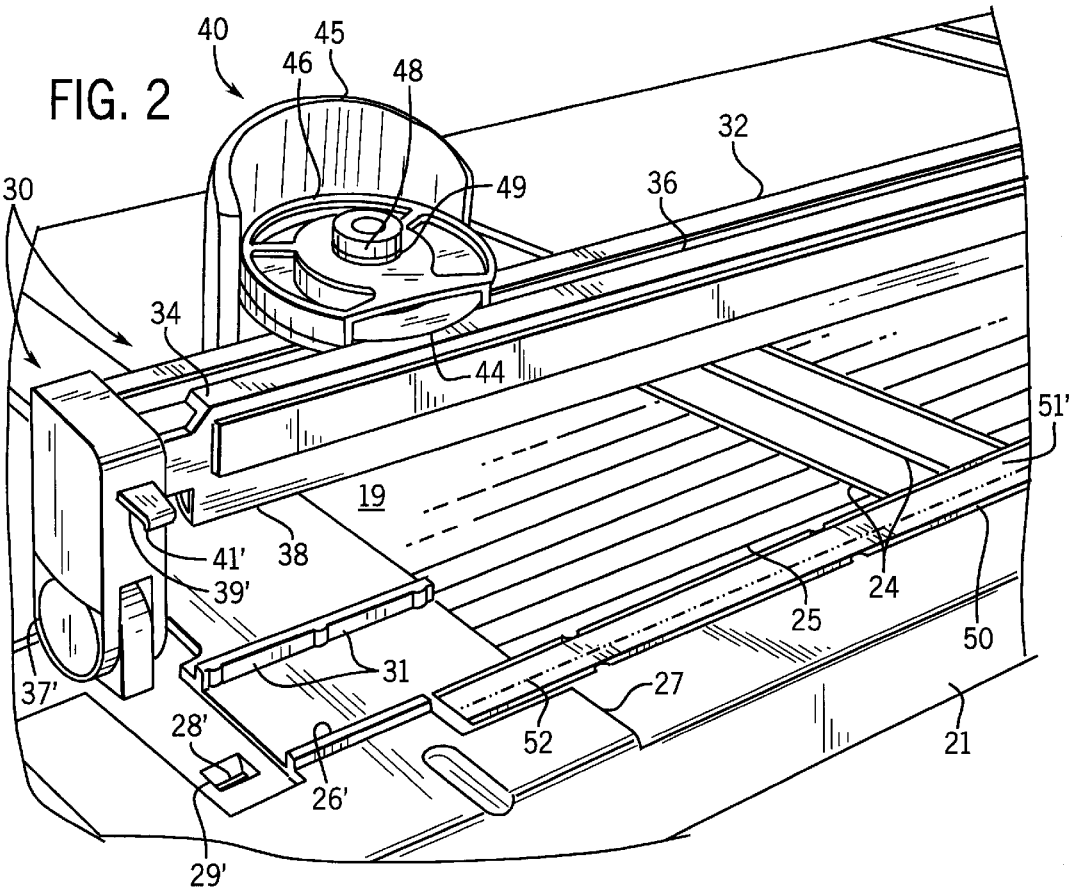
FIG. 2 is an enlarged perspective view of a fragment of the cutting board of FIG. 1, showing the carriage assembly mounted on the rail assembly in an inoperative position.
Figure 3:
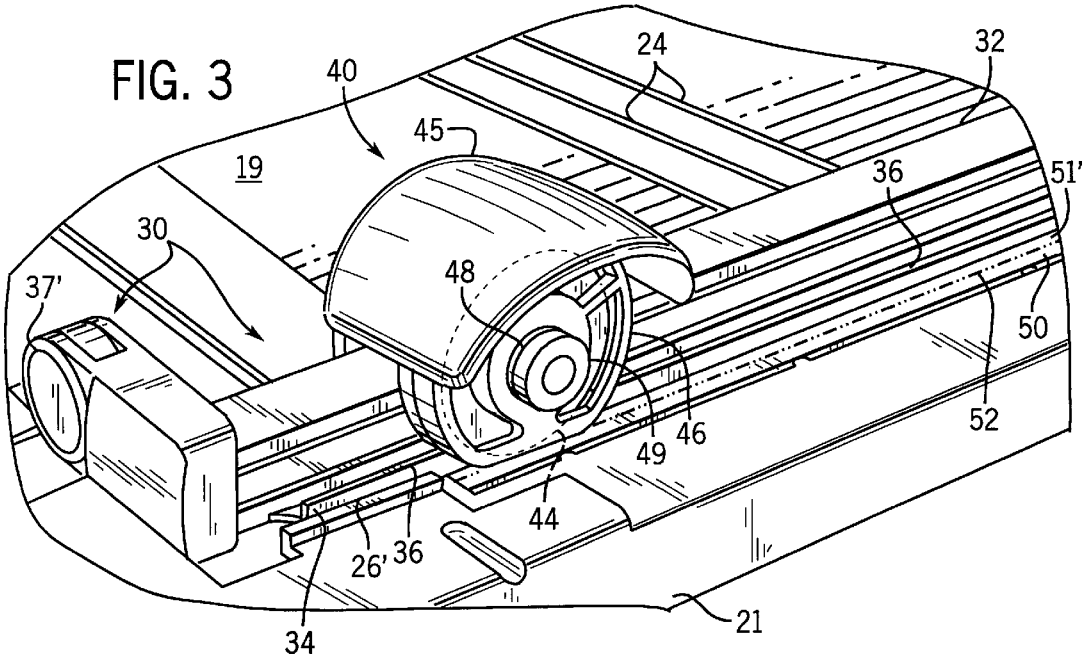
FIG. 3 is a view similar to FIG. 2, but showing the carriage assembly mounted on the rail assembly in the operative position.
Figure 5:
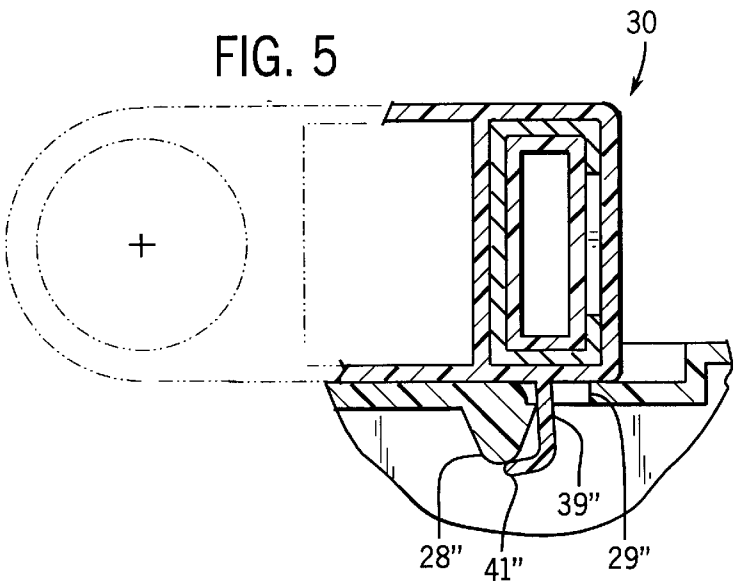
FIG. 5 is an enlarged cross-section view taken along line 5—5 in FIG. 4, showing a resilient tab on the rail assembly engaging a projection beneath an aperture in the cutting board.
Figure 6:
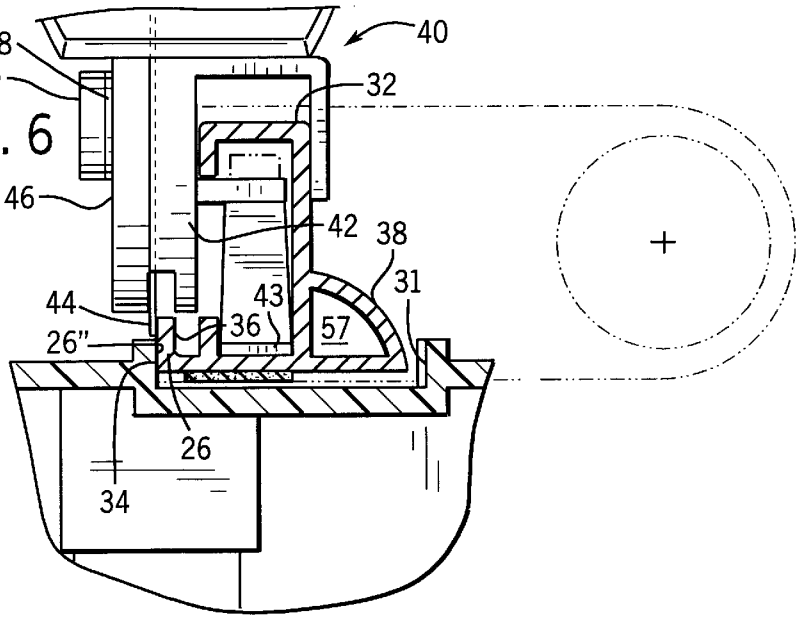
FIG. 6 is an enlarged cross-section view taken along line 6—6 in FIG. 4, showing the rail assembly biased against an upwardly projecting ridge on the cutting board

Referring now to FIGS. 2 and 3, showing a portion of the preferred embodiment in greater detail, FIG. 2 shows rail assembly 30 in a raised non-operating position, and FIG. 3 shows rail assembly 30 in a lowered operating position. Rail assembly 30 includes a pair of resilient tabs 39', 39", and board 20 includes a corresponding pair of apertures 29', 29" and a pair of projections 28', 28" (see FIGS. 2 and 5) such that, when rail assembly 30 is pivoted downward to the operating position, tabs 39', 39" will penetrate respective apertures 29', 29" and be deflected toward edge 21 by projections 28', 28". When tabs 39', 39" are deflected toward edge 21, rail assembly 30 is thereby forced in a lateral direction until a front surface 34 thereof abuts a lateral stop 26 on board 20 (see FIGS. 3 and 6). Alternatively, rail assembly 30 could of course be forced in the opposite direction against an upright ridge 31 (see FIG. 2). Lateral stop 26 preferably comprises a pair of lateral stops 26', 26", each of which is an upright ridge located near respective pivots 37', 37". Resilient tabs 39', 39" preferably each include a bent tip 41', 41" which latches over projection 28', 28" to hold rail assembly 30 in its downward operative position, while tabs 39', 39" simultaneously force assembly 30 in the lateral direction. Alternatively, a separate device could be provided to hold rail assembly 30 in its downward operative position.

In the preferred embodiment, board 20 is injection molded from plastic in an accurate and stable steel die. Thus, stop 26, projection 28, and scales 24 are all features integrally formed in a single (or one-pass) molding operation by the die and molded into the board, rather than molded separately and then assembled. Hence, the dimensional relationships between these interacting items are accurate upon initial manufacture and remain accurate after continued use. Thus, the heretofore commonly experienced weaknesses of rail placement nonrepeatability and inaccuracy relative to indicia scales are substantially eliminated. More specifically, the heretofore known alignment problems resulting from (a) multiple piece-part dimensional tolerances or uncertainties, (b) accumulation of these tolerances upon device assembly in manufacture or service, (c) clearances within pivot assemblies necessary for their operation, and (d) pivot wear are substantially eliminated. Accordingly, a cut line 52 is accurately positioned with respect to scale indicia 24 corresponding to the projected or predetermined cut line determined during the design of the board.

Referring to FIGS. 1–4, board 20 includes material guide stops 27', 27" which are raised edges molded into board 20 perpendicular to cut line 52. In addition, board 20 includes material guide lines 25 which are shallow (but easily perceptible) lines molded into upper surface 19 of board 20 parallel to cut line 52 and aligned with the major divisions of scale indicia 24. For boards 20 manufactured with more than one scale indicia 24, guide lines 25 may be placed at dimensional intervals suitable for each system of units. For example, lines 25' are preferably placed at 0.5 inch intervals emanating from an English unit scale indicia 24', and lines 25" at one centimeter intervals emanating from a metric/SI unit scale indicia 24".

Referring to FIGS. 1–4, 7A, and 7B, a paper cutting mat 50 may absorb excess cutting action from blade 44 which has penetrated the paper and would otherwise cut or score board 20 (or leave a gap which may catch a finger). Mat 50 is constructed of a material with hardness less than that of the blade to avoid dulling the blade's sharpened edge, and is preferably made of a material capable of withstanding many small cuts or scores such as a self-healing rubber or plastic. Mat 50 is configured to be received within a groove 23 provided in upper surface 19 of board 20, and groove 23 has a depth approximately equal to the cross-sectional height of mat 50 so that an upper surface 51' of mat 50 will be approximately flush with upper surface 19 of board 20. Mat 50 is preferably frictionally secured within groove 23 by a slight interference fit with retaining ribs 22. Thus, a user of the device may renew upper surface 51' of mat 50 when it becomes worn by lifting it from groove 23, turning it so that a fresh surface 51" will be uppermost, and reinserting it into groove 23. Thus, mat 50 is preferably of square cross section to provide four useable surfaces, but it may instead be made of rectangular cross section to provide two useable surfaces, triangular cross section to provide three useable surfaces, or some other polyhedron to provide a larger number of useable surfaces. Moreover, mat 50 could be of circular cross section to provide the maximum number of useable surfaces. Additionally, while mat 50 is preferably held in place by frictional fit, it may instead be held in groove 23 by locking tabs or simply by gravity.

Figure 7A:
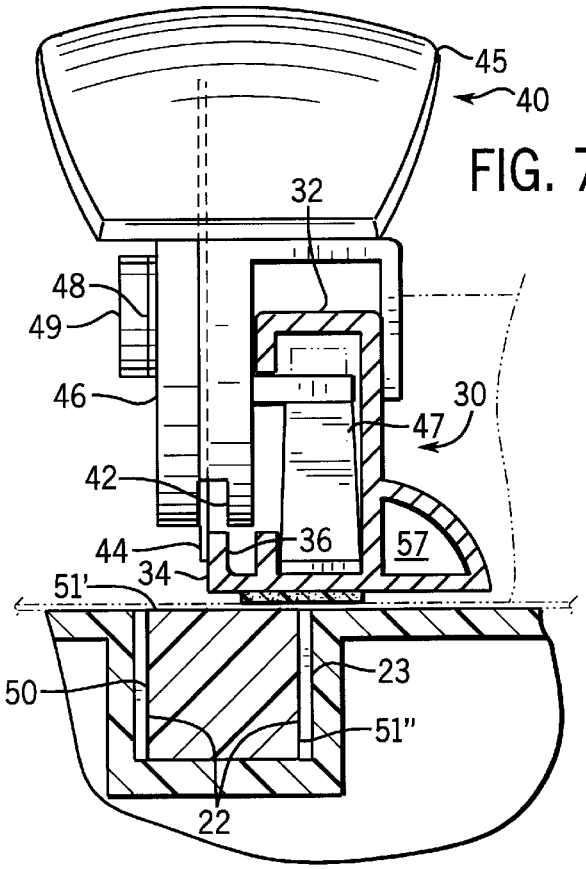
FIG. 7A is an enlarged partial cross-section view taken along line 7—7 in FIG. 4, showing the carriage assembly in a retracted position mounted on the rail.
Figure 7B:
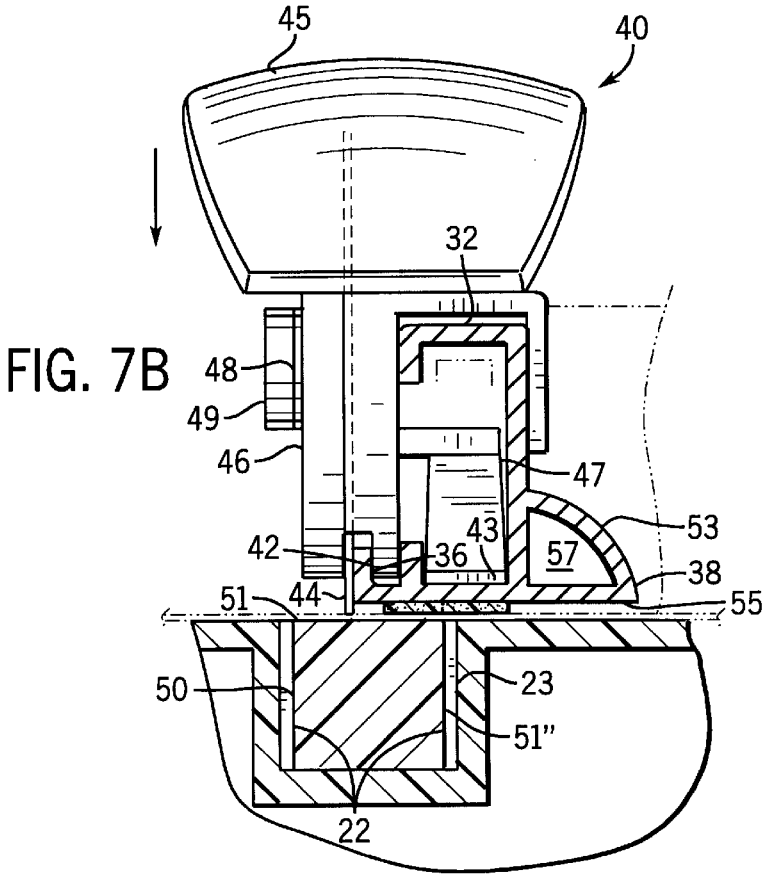
FIG. 7B is a view similar to FIG. 7A, but showing the carriage assembly in a cutting position.

FIGS. 7A and 7B are cross-sectional views taken through rail assembly 30, carriage assembly 40, and mat 50 which show (a) a preferred arrangement for biasing cutter blade 44 upward away from mat 50 to facilitate placement of paper sheets to be cut, (b) a preferred manner of aligning blade 44 with rail assembly 30, and (c) a preferred structure for rail assembly 30 which minimizes deflection of rail 32 from torsional loading during the cutting operation. Preferably, carriage assembly 40 is provided with a biasing spring 47, which bears upon an inner surface 43 of rail 32, to thereby lift carriage assembly 40. Thus, blade 44 is biased upwardly with carriage assembly 40 and away from the paper and mat 50. Spring 47 may be readily overcome by a user pressing a carriage palm pad 45 downward to depress cutter carriage assembly 40 to its operating position, thus forcing blade 44 through the paper and onto or slightly into mat 50.

Blade 44 is biased against front surface 34 of rail assembly 30 when carriage assembly 40 is pushed downwardly into its operating position. Hence, blade 44 is accurately aligned with the predetermined cut line because the same surface (i.e., front surface 34) also engages front lateral stop 26 which, as mentioned above, is formed in the same molding operation as measuring indicia strips 24. Blade 44 is biased by an upwardly extending guide flange 36 on rail assembly 30 which is loosely clamped (when carriage assembly 40 is in the cutting position) between a downwardly extending guide flange 42 on carriage assembly 40 and blade 44 by a nut 49, a spring washer 48, and a blade retainer 46. That is, the distance from blade 44 to flange 42 on carriage 40 is slightly less than the thickness of flange 36 on rail 32. Nut 49 is preferably of a type which allows for adjustment of the clamping force by the operator without need of a tool (e.g., a wing nut, knurled nut, or the like).

Still referring to FIGS. 7A and 7B, the preferred embodiment includes a rail stiffener 38 which is molded or extruded integral with rail 32 (e.g., cast in a single aluminum extrusion molding operation). Stiffener 38 is most effective and least costly if it is provided with a sectional width and height both made significant. Since the outer fibers are most effective in carrying load, stiffener 38 can be made hollow to reduce weight and cost while still providing rail assembly 30 with the needed reinforcement for relatively long cuts. Stiffener 38 preferably has an outwardly bowed side wall 53 and a bottom wall 55, which provides a generally triangular channel 57.

Although a variety of embodiments have been described herein, it should be understood that the above description is of preferred exemplary embodiments of the present invention, and that the invention is not limited to the specific forms described. For example, blade 44 could be a powered rotary blade. In addition, rail assembly 30 could be mounted to slide vertically down toward board 20 to the cutting position, rather than pivoting thereto. Such other constructions are, nevertheless, considered within the scope of this invention. Accordingly, these and other substitutions, modifications, changes and omissions may be made in the design and arrangement of the elements and in their method of operation as disclosed herein without departing from the scope of the appended claims. Advantages provided by the invention include improved accuracy, straightness, and repeatability of cuts, greater ease of setup and use, and increased longevity.

What is claimed is:

1. A paper cutting or trimming device, comprising:

a cutting board including measuring indicia and at least one positive stop, the measuring indicia being calibrated in a scale measured from a predetermined cut line;

a rail assembly mounted in a perpendicular relation to the measuring indicia for pivotal movement between operative and inoperative positions with respect to the cutting board;

a carriage assembly mounted for sliding movement on the rail assembly, the carriage assembly including a circular blade for cutting or trimming paper sheets; and biasing means for biasing the rail assembly against the at least one stop when the rail assembly moves to the operative position, the stop being positioned so that the blade aligns with the cut line;

wherein the biasing means comprises a projection provided beneath an aperture in the cutting board and a resilient tab extending downwardly from the rail assembly, and wherein the tab projects through the aperture when the rail assembly moves to the operative position and is deflected by the projection in a forward direction.

2. The device of claim 1, wherein the resilient tab has a bent tip which latches the projection, whereby the rail assembly is retained in its operative position.

3. A paper cutting or trimming device, comprising:

a cutting board including measuring indicia and at least one positive stop, the measuring indicia being calibrated in a scale measured from a predetermined cut line;

a rail assembly mounted in a perpendicular relation to the measuring indicia for pivotal movement between operative and inoperative positions with respect to the cutting board;

a carriage assembly mounted for sliding movement on the rail assembly, the carriage assembly including a circular blade for cutting or trimming paper sheets; and biasing means for biasing the rail assembly against the at least one stop when the rail assembly moves to the operative position, the stop being positioned so that the blade aligns with the cut line;

wherein the at least one stop comprises a pair of stops provided on the cutting board proximate opposite ends of the rail assembly, the pair of stops configured to engage a portion of the rail assembly when the rail assembly moves to the operative position.

4. The device of claim 3, wherein the portion includes one of a front edge and a rear edge of the rail assembly.

5. The device of claim 4, wherein the biasing means biases the front edge of the rail assembly against the pair of stops.

* * * * *